United States Patent [19]

Honnen

[11] 4,128,403

[45] Dec. 5, 1978

[54] FUEL ADDITIVE FOR DISTILLATE FUELS

[75] Inventor: Lewis R. Honnen, Petaluma, Calif.

[73] Assignee: Chevron Research Company, San Francisco, Calif.

[21] Appl. No.: 700,936

[22] Filed: Jun. 29, 1976

Related U.S. Application Data

[63] Continuation-in-part of Ser. No. 503,984, Sep. 6, 1974, abandoned.

[51] Int. Cl.$^2$ ..... C10L 1/22

[52] U.S. Cl. ..... 44/71; 252/392

[58] Field of Search ..... 44/71, 72, 70; 252/56 R, 51.5 A, 392

[56] References Cited

U.S. PATENT DOCUMENTS

| | | | |
|---|---|---|---|
| 2,682,489 | 6/1954 | vonFuchs | 44/70 |
| 3,034,875 | 5/1962 | Buckmann | 44/58 |
| 3,219,666 | 11/1965 | Norman et al. | 252/51.5 A |
| 3,346,354 | 10/1967 | Kautsky et al. | 44/70 |
| 3,438,757 | 4/1969 | Honnen et al. | 44/72 |
| 3,574,576 | 4/1971 | Honnen et al. | 44/72 |
| 3,752,657 | 8/1973 | Richardson | 44/78 |

*Primary Examiner*—Winston A. Douglas
*Assistant Examiner*—Y. Harris-Smith
*Attorney, Agent, or Firm*—C. J. Tonkin; J. Tedd Brooks

[57] ABSTRACT

A fuel additive is disclosed having improved rust-inhibiting properties and comprises (1) from 5 to 50 weight percent of a hydrocarbyl amine containing at least 1 hydrocarbyl group having a molecular weight between about 300 and 5000, (2) from 0.1 to 10 weight percent of a $C_{12}$ to $C_{30}$ hydrocarbyl succinic acid or anhydride, (3) from 0.1 to 10 weight percent of a demulsifier, and (4) 40 to 90 weight percent of an inert hydrocarbon solvent. A gasoline composition is also disclosed containing from 50 to 400 ppm of the above-identified fuel additive.

16 Claims, No Drawings

FUEL ADDITIVE FOR DISTILLATE FUELS

CROSS REFERENCE TO RELATED APPLICATION

This application is a continuation-in-part of U.S. patent application Ser. No. 503,984, filed Sept. 6, 1974, now abandoned.

BACKGROUND OF THE INVENTION

Gasolines for use in internal combustion engines are often compounded to improve the deposit and wear properties of the fuel. For example, one particular type of additive has been developed which exhibits broad-range detergency and good dispersancy properties. This class of fuel detergent-dispersant additives is commonly known as the polybutene amines. Several patents disclosing the preparation and use of exemplary polybutene amines include U.S. Pat. Nos. 3,438,757; 3,565,804; 3,574,576; and 3,671,511.

These compounded gasolines are often stored in large storage tanks for prolonged periods. Often, moisture from the air condenses within these tanks to form small amounts of water within the storage vessel. Over prolonged periods rusting of the interior of the storage vessels may be encountered, which results in degradation of the storage facility and contamination of the fuel with particulate matter. In addition to the large storage vessels, water often finds access to the fuel tanks of automobiles. As with the large storage tanks, rusting of the automobile gasoline tank leads to the degradation of the tank and the contamination of the fuel with particulate matter.

The polybutene amine additive does not impart any significant anti-rust protection. Hence, a need exists for an additive which may be employed to impart anti-rust properties to fuels such as gasolines, etc., and which is compatible with polybutene amines in fuels.

It is therefore an object of this invention to provide a fuel having improved anti-rust properties.

It is an additional object of this invention to provide a compounded gasoline having improved anti-rust properties.

It is an additional object of this invention to provide a fuel having improved anti-rust properties and containing a polybutene amine additive.

Other objects of this invention will become apparent from the following description of the invention and appended claims.

SUMMARY OF THE INVENTION

I have found that the aforementioned objects and their attendant advantages can be realized by incorporating into a fuel an additive combination comprising (1) 5 to 50 weight percent of a hydrocarbyl amine containing at least 1 hydrocarbyl group having a molecular weight between 300 and 5000, (2) from 0.1 to 10 weight percent of a hydrocarbyl succinic acid or anhydride having from 12 to 30 carbons, (3) from 0.1 to 10 weight percent of a demulsifier, and (4) from 40 to 90 weight percent of an inert hydrocarbon solvent.

While the exact mechanism of the combination of the polybutene amine, the hydrocarbyl succinic acid or anhydride and the demulsifier in effecting superior anti-rust properties is not completely understood, I have found that the particular combination exhibits superior anti-rust properties over use of each additive alone.

It can be theorized that the acid or anhydride protects the metal surface from rusting by laying down a monomolecular layer on the metal surface. The demulsifiers, while not known to give rust protection by themselves, may, because of their limited solubility in gasoline, form a second monomolecular layer on the metal surface in these combinations.

DETAILED DESCRIPTION OF THE INVENTION

The fuel additive and gasoline composition of this invention contains a hydrocarbyl amine having at least one hydrocarbyl group with a molecular weight between 300 and 5000 and a hydrocarbyl succinic acid or anhydride having from 12 to 30 carbons. The weight ratio of hydrocarbyl amine to alkenyl succinic acid should generally vary between 250 and 10, and perferably from 150 to 25.

The hydrocarbyl amine can be conveniently prepared by reacting a hydrocarbyl halide having from 1 to 5 halide atoms and less than 10% of the available sites substituted with a halogen atom with a mono- or polyamine having from 1 to 10 amine nitrogens with at least one primary or secondary amino group and having from 2 to 40 carbon atoms with a carbon to nitrogen ratio between about 1 and 10:1.

The hydrocarbyl halides used to prepare the hydrocarbyl amines may be prepared by numerous commercially available processes. In a preferred embodiment, the hydrocarbyl portion may be prepared by ionic or free radical polymerization of $C_2$ to $C_6$ mono-olefins (when ethylene is employed, it must be copolymerized with another higher olefin) to an olefin polymer having a number average molecular weight of about 300 to 5000, and preferably from about 1000 to 2500, and more preferably from about 1000 to 2000. Exemplary olefins which may be polymerized include ethylene, propylene, isobutylene, 1-butene, 1-pentene, 3-methyl-1-pentene, 4-methyl-1-pentene, etc., and preferably propylene and isobutylene.

The olefin polymer should have, as an average, at least one branch per six carbons along the chain, and preferably at least one branch per four carbons. The preferred olefins (propylene and isobutylene) have from 0.5 to 1 branch per carbon atom along the hydrocarbon chain.

While halogenating the olefin polymers is preferred, it is recognized that the hydrocarbyl halides may be prepared by halogenating lube oil fractions, paraffin waxes, etc.

The halogen may be introduced into the hydrocarbon molecule by various means known in the art. Most readily, either chlorine or bromine may be introduced by the free radical catalyzed halogenation of the hydrocarbon, or ionic addition to olefinic unsaturation. Various free radical catalysts may be used, such as peroxides, azo compounds, bromine, iodine, as well as light. Ionic catalysts are exemplified by ferric chloride. Methods of halogenation are well known in the art and they do not require extensive illustration here.

The amount of halogen introduced into the olefin polymer will depend on the particular hydrocarbon used, the desired amount of amine to be introduced into the molecule, the particular alkylene amine used, and the halogen used. However, the amount of halogen introduced will generally be in the range from about 1 to 5 halogen atoms per molecule, depending on the reactivity of the resulting halide. On a weight basis, the amount of halide will generally range from 1 to 25, more usually from 1 to 10 weight percent.

The mono- or polyamine component employed to prepare the hydrocarbyl amine embodies a broad class amines having from 1 to 10 amine nitrogens and from 2 to 40 carbons with a carbon to nitrogen ratio between about 1 and 10:1. In most instances, the amine component is not a pure single product, but rather a mixture of compounds having a major quantity of the designated amine. For more complicated polyamines, the compositions will be a mixture of amines having as the major product the compound indicated in the average composition and having minor amounts of analogous compounds relatively close in composition to the dominant compounds.

It should be noted that while I refer to the mixture of this invention as hydrocarbyl amines, it does not mean that these amines are made solely of carbon, hydrogen and amino groups. For example, the compounds may contain minor amounts of oxygen, sulfur, non-amino nitrogen, etc. and may include small amounts of halogen.

In order to avoid extensive exemplification in the illustration of various amines in the preparation of hydrocarbon amines herein, Applicant refers to U.S. Pat. Nos. 3,438,757; 3,565,804; 3,574,576; and 3,671,511; and incorporates the same herein by reference.

The hydrocarbyl succinic acid component of this invention preferably has from 12 to 30 carbons, and more preferably from 15 to 20 carbons. The hydrocarbyl-substituted succinic acid or anhydride may be prepared by the reaction of an olefin with maleic acid or maleic anhydride. In one embodiment of the invention an alpha-olefin, such as those obtained from cracking wax (cracked wax olefins), is reacted with maleic anhydride or maleic acid to form an alkenyl succinic acid or anhydride. This product may then be hydrogenated to form the alkyl succinic anhydride or acid. However, in most instances there will be little advantage, if any, in the alkyl over the alkenyl succinic acid or anhydride. The methods of reacting an olefin with maleic anhydride are well known in the art and do not require exemplification here. Illustrative of various alpha-olefins which may find use are 1-dodecene, 1-tridecene, 1-tetradecene, 1-pentadecene, etc.

When the addition reaction with maleic anhydride is utilized, or otherwise, it is often desirable to use as the olefinic hydrocarbon reactant a low molecular weight polymer of a $C_2$ to $C_4$ olefin (i.e., an oligomer of $C_2$ to $C_4$ olefin). Such oligomers are represented by tetrapropylene, triisobutylene, tetraisobutylene, etc. Such oligomers are mono-olefins of a straight or branched chain structure.

A particularly preferred method in preparing the reaction product of this invention is the addition of the oligomer tetrapropylene to maleic acid anhydride or acid.

The demulsifier component is one of the compounds which is known to cause separation (demulsification) of hydrocarbon-water and more usually gasoline-water emulsions. Materials such as lecithin which are more usually known as oil-water demulsifiers are also suitable. Numerous demulsifiers are commercially availabe and may be employed in the practice of this invention. A particularly active demulsifier is an alkoxy-modified methylene-bridged polyalkyl phenol. These compounds may be prepared by condensing an alkylated phenol with formaldehyde to form a methylene-bridged polyalkylated phenol, which is then contacted with an alkylene oxide, such as ethylene oxide or propylene oxide. A particularly active demulsifier is prepared by reacting 5 molar parts of an alkylphenol with 4 to 5 molar parts of formaldehyde, the reaction product of which is reacted with about 20 to 50 molar parts of ethylene oxide. Temporary alkylphenols which may be employed include p-isobutylphenol, p-hexylphenol, p-octylphenol, p-nonylphenol, p-tripropylenephenol, etc. Generally, the number of carbon atoms within the alkylphenol will range from 8 to 24.

Another type of demulsifier component is a sulfonated alkylphenyl, and preferably an ammonia-neutralized sulfonated alkylphenol. These compounds are prepared by simply sulfonating an alkylated phenol. Neutralized sulfonated alkylphenols are prepared by reacting the sulfonated alkylphenol with ammonia.

Another type of demulsifier is an oxyalkylated glycol. These compounds are prepared by reacting a polyhydroxy alcohol, such as ethylene glycol, trimethylene glycol, etc., with ethylene oxide or propylene oxide. Many of these compounds are commercially available from Wyandot Chemical Company under the Pluronic trademark. They are polyethers terminated by hydroxyl groups introduced by the block copolymerization of ethylene and propylene. The ethylene oxide blocks act as the hydrophyls and the propylene oxide blocks add the hydrophobes. They are available in a wide range of molecular weight and with varying ratios of ethylene oxide to propylene oxide blocks.

Lecithin, as has been noted, is another suitable demulsifier.

The above-demulsifier components may be employed individually or in mixtures. A particularly active demulsifier is a mixture of 10 to 90 parts of alkoxy-modified methylene-bridged polyalkylphenol, 10 to 90 parts of ammonia-neutralized sulfonated alkylphenol, and 10 to 90 parts of an oxyalkylated glycol, per 100 parts of total demulsifier employed.

FUEL ADDITIVE COMPOSITION

When the combination of the hydrocarbyl amine, the hydrocarbyl succinic acid and the demulsifier are employed as an additive, it will usually be combined with an inert hydrocarbon solvent. Thus, the hydrocarbyl amine will compose approximately 5 to 50 weight percent, preferably from 10 to 40 weight percent of the fuel composition. The hydrocarbyl amine must have at least one hydrocarbyl group having a molecular weight from 300 to 5000, and preferably from 1000 to 2500. The second component, the hydrocarbyl succinic acid or anhydride, will be present in an amount from 0.1 to 20 weight percent, more preferably from 0.5 to 10 weight percent and has from 12 to 30 carbons, preferably from 15 to 20 carbons. The weight ratio of hydrocarbyl amine to hydrocarbyl succinic acid or anhydride within the combination generally range from 250 to 10, and preferably from 150 to 25. The third component, the demulsifier, will be present in an amount of from 0.1 to 10% by weight.

The third major component is an inert hydrocarbon solvent. The solvent may be aliphatic or aromatic so long as it is liquid at ambient conditions and provides good solubility for the hydrocarbyl succinic acid or anhydride and the hydrocarbyl amine. A particularly good solvent is a hydrocarbon petroleum oil having a viscosity of 50 to 3000 SUS at 210° F. preferably having a viscosity of 100 to 500 SUS at 210° F. In a more preferred embodiment, an aromatic hydrocarbon having from 6 to 12 carbons is also incorporated in said hydrocarbon oil.

A GASOLINE COMPOSITION

When the combination is used in a finished compounded gasoline, it is generally composed of a distillate fuel fraction having from 100 to 2000 ppm of the fuel additive, and preferably from 200 to 800 ppm of the fuel additive above-described. The combination of the hydrocarbyl amine, the hydrocarbyl succinic acid or anhydride and the demulsifier within the fuel will generally range as follows: the hydrocarbyl amine will generally be present in an amount from 50 to 800 ppm, and preferably from 100 to 400 ppm. The amount of a hydrocarbyl succinic acid or anhydride present will generally vary from 0.5 to 20 ppm, and preferably from 1 to 10 ppm. The demulsifier will be present in the amount of from 1 to 20 ppm, preferably 3 to 10 ppm. The ratio of hydrocarbyl amine to hydrocarbyl succinic acid within the fuel composition will be the same as in the fuel additives.

In addition to the hydrocarbyl amine and hydrocarbyl succinic acid or anhydride, other additives may be successfully employed within the fuel and additive composition of this invention. Such additives include anti-knock agents, e.g., tetramethyl lead or tetraethyl lead, other dispersants such as various substituted succinimides, etc. Also included may be lead scavengers such as aryl halides, e.g., an acryl benzene or alkyl halides, e.g., ethylene dibromide. Anti-oxidants may also be present.

The following examples are presented to illustrate the practice of specific embodiments of this invention, and should not be interpreted as limitations upon the scope of this invention as defined by the appended claims.

EXAMPLE

In this example, eight gasoline compositions are prepared and subjected to the ASTM D-665 rust rating. Test sample A is a base gasoline composition containing no additives. Test sample B is composed of the base fluid containing 0.5 ppm of tetrapropenyl succinic acid. Test sample C is the same as test sample B except containing 2 ppm of tetrapropenyl succinic acid. Test sample D is the same as test sample C except containing 5 ppm of tetrapropenyl succinic acid. Test sample E is composed of the base fluid as employed in test sample A containing 0.5 ppm of tetrapropenyl succinic acid, 125 ppm of a commercial polybutene amine prepared by reacting polyisobutene chloride having a number average molecular weight in the polyisobutene portion of about 1400 with ethylene diamine, and 7.5 ppm of a commercial demulsifier. Test sample F is the same as test sample E except containing 2 ppm of tetrapropenyl succinic acid. Test sample G is the same as test sample E except containing 5 ppm of tetrapropenyl succinic acid. Test sample H is composed of the base fuel, as employed in test sample A, plus 125 ppm of polybutene amine disclosed in test sample E and 7.5 ppm of a commercial demulsifier.

Test sample I contains the base fuel, 125 ppm of the polybutene amine and 10 ppm of polybutene succinic anhydride (molecular weight about 430). Test sample J is the same as I but contains, in addition, 5 ppm of lecithin demulsifier. K is the same as I, but contains, in addition, 5 ppm of a commercial demulsifier, Exxon Breaxit 7890. L is the same as I, but contains, in addition, 5 ppm of a commercial demulsifier, Exxon Breaxit 941.

Polished steel spindles are immersed in the test sample containing 3 weight percent of synthetic sea water for eighteen hours. At the end of the 18-hour period, the spindles are removed and observed. Visual observation of the rust on the spindles is reported in the following Table I.

TABLE I

| | ASTM Rust Test | | | |
|---|---|---|---|---|
| Sample No. | Tps Acid[1] ppm | Pbs Anhydride[2] ppm | Hydrocarbyl Amine, ppm | ASTM Rust Rating |
| A | — | | — | Severe Rust |
| B | 0.5 | | — | Severe Rust |
| C | 2 | | — | Severe Rust |
| D | 5 | | — | Severe Rust |
| E | 0.5 | | 125 | Moderate Rust |
| F | 2 | | 125 | Moderate Rust |
| G | 5 | | 125 | Light Rust |
| H | — | | 125 | Severe Rust |
| I | | 10 | 125 | Moderate Rust |
| J | | 10 | 125 | Light Rust |
| K | | 10 | 125 | Light Rust |
| L | | 10 | 125 | Light Rust |

[1]Tetrapropenyl succinic acid
[2]Polybutene succinic anhydride (MW#430)

These data show that the binary combinations of amine and acid (or anhydride) reduce rusting. The addition of the demulsifier reduces rusting even further.

What is claimed is:

1. A fuel additive comprising from 40 to 90 weight percent of an inert hydrocarbon solvent, from 5 to 50 weight percent of a hydrocarbyl amine having at least one hydrocarbyl group having a molecular weight between 300 and 5000, and 0.1 to 10 weight percent of a hydrocarbyl succinic acid or anhydride having from 12 to 30 carbons, and from 0.1 to 10 weight percent of a demulsifier.

2. The composition defined in claim 1 wherein the weight ratio of hydrocarbyl amine to alkenyl succinic acid or anhydride is between about 250 and 10.

3. The composition of claim 1 wherein the demulsifier is an alkoxy-modified methylene-bridged alkylphenol.

4. The composition of claim 1 wherein the demulsifier is an ammonium-neutralized sulfonated alkylphenol.

5. The composition of claim 1 wherein the demulsifier is an oxyalkylated glycol.

6. The composition of claim 1 in which the demulsifier is lecithin.

7. The composition defined in claim 1 wherein said hydrocarbyl succinic acid or anhydride is tetrapropenyl succinic acid.

8. The composition defined in claim 1 wherein said hydrocarbyl amine is a polybutene amine having a molecular weight in the polybutene portion of about 1000 to 2500.

9. A gasoline composition containing (1) a major portion of a gasoline fuel fraction, (2) from 50 to 800 ppm of a hydrocarbyl amine having at least 1 hydrocarbyl group with a molecular weight between 300 and 5000, (3) 0.5 to 20 ppm of a hydrocarbyl succinic acid or anhydride having from 12 to 30 carbons, and (4) from 2 to 10 ppm of a demulsifier.

10. The composition defined in claim 9 wherein said hydrocarbyl succinic acid is tetrapropylene succinic acid.

11. The composition defined in claim 9 wherein the ratio of the hydrocarbyl amine to alkenyl succinic acid is between 250 and 10.

12. The composition defined in claim 9 wherein the hydrocarbyl amine is a polybutene amine having a molecular weight in the polybutene portion of 1000 to 2500.

13. The composition of claim 9 in which the hydrocarbyl succinic anhydride is polybutene succinic acid.

14. The composition of claim 9 in which the demulsifier is an alkoxy-modified methylene-bridged alkylphenol.

15. The composition of claim 9 in which the demulsifier is an ammonium-neutralized sulfonated alkylphenol.

16. The composition of claim 9 in which the demulsifier is lecithin.

* * * * *